US008782981B2

(12) United States Patent
Lampus

(10) Patent No.: US 8,782,981 B2
(45) Date of Patent: Jul. 22, 2014

(54) STRUCTURAL UNIT INSULATION ARRANGEMENT, SYSTEM, AND PROCESS

(71) Applicant: R. I. Lampus Company, Springdale, PA (US)

(72) Inventor: Donald L. Lampus, Fox Hall, PA (US)

(73) Assignee: R.I. Lampus Company, Springdale, PA (US)

( * ) Notice: Subject to any disclaimer, the term of this patent is extended or adjusted under 35 U.S.C. 154(b) by 0 days.

(21) Appl. No.: 13/906,418

(22) Filed: May 31, 2013

(65) Prior Publication Data

US 2013/0318902 A1 Dec. 5, 2013

Related U.S. Application Data

(60) Provisional application No. 61/654,152, filed on Jun. 1, 2012.

(51) Int. Cl.
*E04C 1/41* (2006.01)

(52) U.S. Cl.
USPC ..... 52/405.1; 52/407.1; 52/309.12; 52/606; 52/742.13

(58) Field of Classification Search
USPC ..... 52/309.11, 309.12, 405.1, 407.1, 407.5, 52/603, 606, 609, 742.13
See application file for complete search history.

(56) References Cited

U.S. PATENT DOCUMENTS

| | | | | | |
|---|---|---|---|---|---|
| 1,844,922 | A | * | 2/1932 | Wallace | 52/592.6 |
| 2,268,251 | A | * | 12/1941 | Haux | 52/405.1 |
| 2,971,616 | A | * | 2/1961 | Bayley, Jr | 52/406.1 |
| 3,264,165 | A | * | 8/1966 | Stickel | 428/69 |
| 3,307,312 | A | * | 3/1967 | Kreibaum | 52/302.3 |
| 3,464,179 | A | * | 9/1969 | Muhlen et al. | 52/570 |
| 4,073,111 | A | * | 2/1978 | Warren | 52/407.1 |
| 4,380,887 | A | * | 4/1983 | Lee | 52/405.1 |
| 4,399,645 | A | * | 8/1983 | Murphy et al. | 52/742.13 |
| 4,529,638 | A | * | 7/1985 | Yamamoto et al. | 428/69 |
| 4,854,097 | A | * | 8/1989 | Haener | 52/309.11 |
| 8,549,811 | B2 | * | 10/2013 | Dyson | 52/604 |

FOREIGN PATENT DOCUMENTS

EP 146529 A2 * 6/1985 ..... E04C 1/40

OTHER PUBLICATIONS

StandardSpecification for Loadbearing Concrete Masonry Units, Designation C90-11 b. ASTM International, Jan. 2012, 4 pages.
Standard Specification for Loadbearing Concrete Masonry Units, Designation C90-06b. ASTM International, Jan. 2007, 4 pages.

* cited by examiner

*Primary Examiner* — Brian Glessner
*Assistant Examiner* — Adriana Figueroa
(74) *Attorney, Agent, or Firm* — The Webb Law Firm

(57) ABSTRACT

A structural unit includes a first face shell; a second face shell positioned opposite the first face shell; at least one central web connecting the first face shell to the second face shell; a first partial web forming a gap between an end of the first partial web and a first edge of the second face shell, and defining a first cavity; and a second partial web forming a gap between an end of the second partial web and a second edge of the second face shell, and defining a second cavity.

13 Claims, 6 Drawing Sheets

STRUCTURAL UNIT INSULATION ARRANGEMENT, SYSTEM, AND PROCESS

CROSS REFERENCE TO RELATED APPLICATION

This application claims the benefit of U.S. Provisional Patent Application No. 61/654,152 filed on Jun. 1, 2012, on which priority of this patent application is based and which is hereby incorporated by reference in its entirety.

BACKGROUND OF THE INVENTION

1. Field of the Invention

The present disclosure relates generally to the manufacture and use of structural units, such as concrete masonry units and the like, and in particular to an insulation arrangement, system, and process for use in manufacturing or forming insulated structural units for construction and installation processes.

2. Description of the Related Art

As is known in the construction industry, one of the basic components of many building structures is a structural unit, such as a concrete masonry unit (CMU). In particular, conventional CMUs are used in constructing and installing buildings, foundations, walls, load-bearing structures, and the like. When used in connection with foundations or walls that are a part of dwellings or other building structures, existing CMUs must meet certain specified requirements, such as the requirements set forth in ASTM C90-06b, entitled "Standard Specification for Loadbearing Concrete Masonry Units". This standard relates to hollow and solid CMUs that are manufactured from hydraulic cement, water, and mineral aggregates.

A typical CMU may be a solid form, or in most instances, include hollow areas or portions. For example, as seen in FIGS. 1(*a*) and 1(*b*), CMU; 100 includes a first face shell 102 and a second face shell 104 connected by three webs 106. Under the above-referenced ASTM C90-06b standard, there are minimum thicknesses for the face shells 102, 104 and webs 106. For example, for an 8-inch nominal width unit, the minimum face shells 102, 104 thicknesses are 1¼ inch, and the minimum web 106 thickness is 1 inch. This translates into an equivalent web thickness of 2¼ inches per linear foot of the CMU 100.

It is further noted that certain new requirements are now set forth in ASTM C90-11b, entitled "Hollow Loadbearing Concrete Masonry Units", which is discussed in Architecture/Engineering/Construction Industry Update published by the National Concrete Masonry Association. Under the ASTM C90-11b standard, the minimum face shells 102, 104 thicknesses remain at 1¼ inch, for an 8-inch nominal width unit, while the minimum web 106 thickness is now ¾ inch, with a minimum web 106 cross-sectional area of 6.5 square inches per square foot. Under the ASTM C90-11b standard, greater configuration possibilities exist for forming a CMU 100 that still meets the construction criteria.

It is also known in the industry that certain applications and uses of CMUs 100 require the provision of insulation. In some instances, such insulated units must exhibit a specified minimum insulation R-value, which relates to a measure of thermal resistance (i.e., resistance to heat flow) in a given thickness of material. Generally, the R-value is the ratio of the temperature difference across an insulator and the heat flux. The higher the R-value, the more effective the insulation is at resisting heat flow. In order to provide such an insulative component to a CMU 100, particularly a hollow CMU 100 shown in FIGS. 1(*a*) and 1(*b*), an insulation insert 108 can be used. As discussed above, a typical CMU 100 includes two face shells 102, 104 and three webs 106, thus forming a first cavity 110 and a second cavity 112. A respective insulation insert 108 can be positioned in each of the first cavity 110 and the second cavity 112. During installation, and as the structure is being built, each CMU 100 is stacked and mortar applied to join the edges. Further, in such an installation, the insulation inserts 108 are positioned adjacent the face shell 104 that will be facing outside of the structure after installation. In this manner, an insulated structure is provided.

In general, the insulation inserts 108 are inserted in the cavitys 110, 112 after the manufacture of the CMU 100. Normally, these insulation inserts 108 are frictionally engaged within one or more of the cavitys 110, 112, as illustrated in FIGS. 1(*a*) and 1(*b*). These insulation inserts 108 normally only "fill" a portion of the respective cavitys 110, 112. However, the insulation inserts 108 do not provide insulation across the entire length of the CMU 100 due to the presence of a center web 106. Additionally, the insulation inserts 108 do not insulate the seams or joints that result from building a structure with multiple CMUs 100.

Within the prior art, certain other configurations of CMUs exist with variable arrangements and geometries with respect to the placement and positioning of the webs 106. However, all such existing CMUs suffer from these same drawbacks; namely, the insulation inserts 108 must be specifically positioned after forming and curing the CMU 100, and even after positioning, and such known insulation inserts 108 do not provide a full insulation barrier. Accordingly, for those applications or structures that are required to meet or exceed a certain R-value, the existing CMU 100 arrangement with insulation inserts 108 is not effective.

One example of a CMU that uses known insulation inserts is illustrated in the "Fabri-Core Profile Series Specification Sheet". This CMU has the face shells and webs that provide cavitys with insulation inserts positioned therein to provide a specified R-value based upon the block density.

SUMMARY OF THE INVENTION

Accordingly, and generally, provided are a structural unit insulation arrangement, system, and process that address and/or overcome some and/or all of the deficiencies and drawbacks associated with existing structural unit insulation arrangements.

In accordance with one preferred and non-limiting embodiment, a structural unit includes a first face shell having a first edge and a second edge and a second face shell having a first edge and a second edge, where the second face shell is positioned opposite the first face shell. The structural unit further includes at least one central web connecting the first face shell to the second face shell (preferably at a substantially central portion of the first face shell and the second face shell). A first partial web extends from the first edge of the first face shell toward the first edge of the second face shell and forms a gap between an end of the first partial web and the first edge of the second face shell. A first cavity is defined by the first face shell, the second face shell, the at least one central web, and the first partial web. A second partial web extends from the second edge of the first face shell toward the second edge of the second face shell and forms a gap between an end of the second partial web and the second edge of the second face shell. A second cavity is defined by the first face shell, the second face shell, the at least one central web, and the second partial web.

In accordance with a further preferred and non-limiting embodiment, the structural unit additionally includes a first insulation material provided in at least one of the first and second cavities. The first insulation material is provided in at least a portion of the first and second cavities, such that the first insulation material at least partially fills the gap. The first insulation material is a closed-cell foam material sprayed into the first and second cavities.

In yet another preferred and non-limiting embodiment, a second insulation material is provided within at least a portion of the first insulation material. The second insulation material is formed by mixing a first insulation component and a second insulation component. The first insulation component is stored in a first container and the second insulation component is stored in a second container, wherein, upon release from the first and second containers, the first and second insulation components mix to form the second insulation material. At least one of the first and second containers is formed as one of a tube, a capsule, and a bubble that is dissolved by contact with water or moisture, or by application of mechanical or electromagnetic energy. The first and second containers are retained within at least one recess formed within at least one of the first insulation material and the central web. The first and second containers are retained within the at least one recess by an adhesive or by frictional engagement with the at least one recess. A plurality of recesses is formed within the at least one of the first insulation material and the central web.

In another preferred and non-limiting embodiment, an insulated masonry block for use as a structural unit in a structure includes a first face shell having a first edge and a second edge and a second face shell having a first edge and a second edge, where the second face shell is positioned opposite the first face shell. The structural unit further includes at least one central web connecting the first face shell to the second face shell at a substantially central portion of the first face shell and the second face shell. A first partial web extends from the first edge of the first face shell toward the first edge of the second face shell and forms a gap between an end of the first partial web and the first edge of the second face shell. A first cavity is defined by the first face shell, the second face shell, the at least one central web, and the first partial web. Similarly, a second partial web extends from the second edge of the first face shell toward the second edge of the second face shell and forms a gap between an end of the second partial web and the second edge of the second face shell. A second cavity is defined by the first face shell, the second face shell, the at least one central web, and the second partial web. A first insulation material is provided in at least one of the first and second cavities, where the first insulation material at least partially fills the gap.

In accordance with another preferred and non-limiting embodiment, a second insulation material is provided within at least a portion of the first insulation material as a multiple-component material formed by mixing a first insulation component and a second insulation component. The first insulation component is stored in a first container and the second insulation component is stored in a second container, wherein, upon release from the first and second containers, the first and second insulation components mix to form the second insulation material. At least one of the first and second containers is formed as one of a tube, a capsule, and a bubble that is dissolved by contact with water or moisture, or by application of mechanical or electromagnetic energy. The first insulation material is a foam material sprayed into the first and second cavities.

In a further preferred and non-limiting embodiment, a method of manufacturing an insulated masonry block for use as a structural unit in a structure includes the steps of manufacturing the masonry block and providing a first insulation material within at least one cavity of the masonry block. In one preferred and non-limiting embodiment, the masonry block includes a first face shell having a first edge and a second edge and a second face shell having a first edge and a second edge, where the second face shell is positioned opposite the first face shell. The structural unit further includes at least one central web connecting the first face shell to the second face shell at a substantially central portion of the first face shell and the second face shell. A first partial web extends from the first edge of the first face shell toward the first edge of the second face shell and forms a gap between an end of the first partial web and the first edge of the second face shell. A first cavity is defined by the first face shell, the second face shell, the at least one central web, and the first partial web. A second partial web extends from the second edge of the first face shell toward the second edge of the second face shell and forms a gap between an end of the second partial web and the second edge of the second face shell. A second cavity is defined by the first face shell, the second face shell, the at least one central web, and the second partial web.

The method may further include the step of providing a second insulation material within at least a portion of the first insulation material. The second insulation material is formed by mixing a first insulation component and a second insulation component. The first insulation component is stored in a first container and the second insulation component is stored in a second container, wherein, upon release from the first and second containers, the first and second insulation components mix to form the second insulation material.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

FIG. 1(*b*) is a top view of the prior art concrete masonry unit of FIG. 1(*a*);

FIG. 2(*b*) is a top view of the concrete masonry unit of FIG. 2(*a*);

FIG. 3(*b*) is a top view of the concrete masonry unit of FIG. 3(*a*);

DETAILED DESCRIPTION OF THE PREFERRED EMBODIMENTS

Figure 1A:
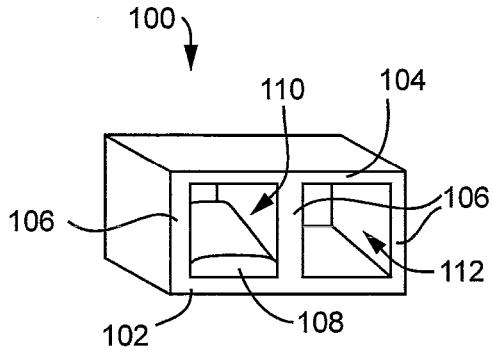
Fig. 1(a) PRIOR ART
FIG. 1(*a*) is a perspective view of a concrete masonry unit with an insulation insert according to prior art embodiment.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The present invention is directed to a structural unit insulation arrangement, system, and process, as illustrated in various preferred and non-limiting embodiments in FIGS. 2-6. As discussed hereinafter, structural unit insulation arrangements, systems, and processes can be used in connection with and embody a variety of structural units, but has particular application in connection with concrete masonry units (CMUs). Accordingly, while discussed hereinafter primarily in connection with such CMUs, the arrangements, systems, and processes described herein can be equally useful in connection with other types of structural or modular units for use in constructing and installing buildings, foundations, walls, load-bearing structures, and the like.

Figure 2A:
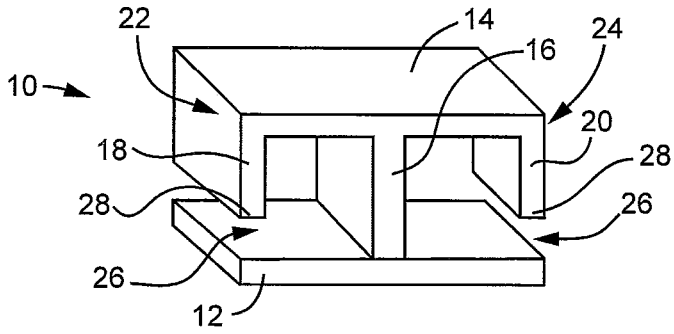
FIG. 2(*a*) is a perspective view of a concrete masonry unit according to the principles of one embodiment of the present invention.
Figure 2B:
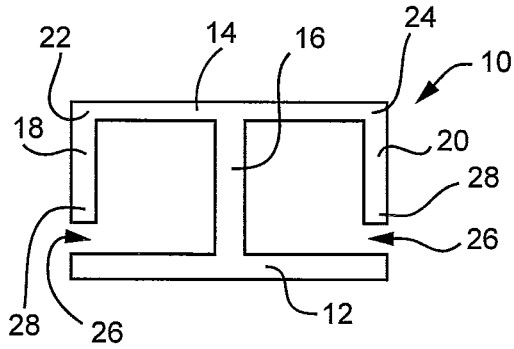

In one preferred and non-limiting embodiment illustrated in FIGS. 2(*a*) and 2(*b*), provided is a concrete masonry unit 10 (or "CMU"). In this embodiment, the CMU 10 includes a first face shell 12 and a second face shell 14. In addition, a central web 16 connects the first face shell 12 to the second face shell 14, preferably at a substantially central portion thereof. In addition, a first partial web 18 extends from a first edge 22 of the second face shell 14, and a second partial web 20 extends from a second edge 24 of the second face shell 14. As these partial webs 18, 20 do not extend fully between the first face shell 12 and the second face shell 14, as does the central web 16, a gap 26 is formed between the first face shell 12 and an end 28 of the first partial web 18 and second partial web 20.

The width of the central web 16 can be manufactured to meet any appropriate specification or standard, su ASTM as the above-discussed ASTM C90-06b and ASTM C90-11b standards. In particular, the equivalent thickness of web 16 may be manufactured in accordance with Table 1 of the ASTM C90-06b standard, and based upon the nominal width and length of the CMU 10. In one preferred and non-limiting embodiment, this central web 16 is ¾ inch in width. However, the width of the central web 16 may be formed to meet any specification or standard for any application in which the CMU 10 is utilized.

Figure 3A:
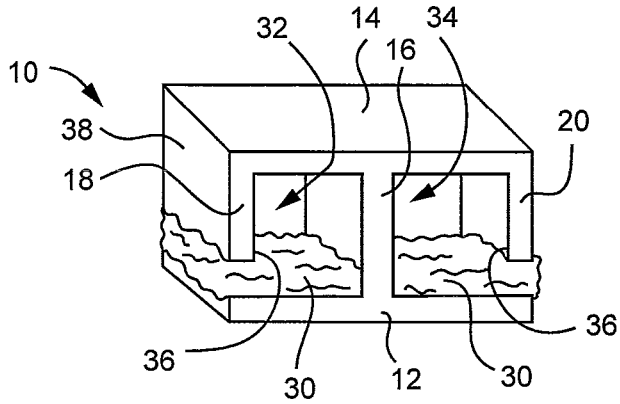
FIG. 3(*a*) is a perspective view of an insulated concrete masonry unit according to the principles of one embodiment of the present invention.
Figure 3B:
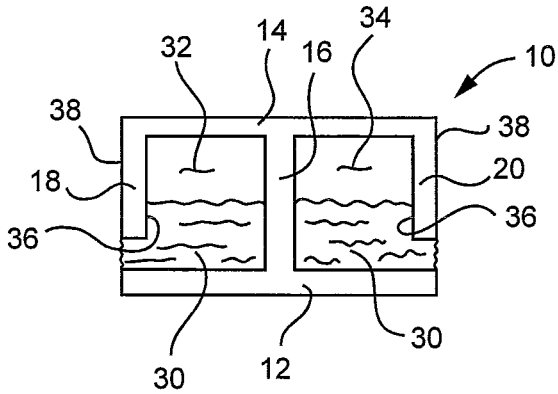

A further embodiment of the CMU 10 is illustrated in FIGS. 3(*a*) and 3(*b*). In this preferred and non-limiting embodiment, an insulation material 30 is provided in one or both of a first cavity (or hollow portion) 32 and a second cavity (or hollow portion) 34, each of which is formed by the first face shell 12, the second face shell 14, the central web 16, and either the first partial web 18 or the second partial web 20. As discussed above, and in one preferred and non-limiting embodiment, the insulation material 30 may only be provided in a portion of the first cavity 32 and/or the second cavity 34. Of course, if desired, the entire first cavity 32 and/or the second cavity 34 may be filled with thus insulation material 30.

In a further preferred and non-limiting embodiment, only one partial web 18, 20 is provided, with the other web extending completely between the first face shell 12 and the second face shell 14. In addition, the gap 26 may be formed only partially across or through the partial web 18, 20, such as in the form of a hole or other space positioned on or in the partial web 18, 20. Still further, it is envisioned that a gap may be formed on or extend through a portion of the central web 16, thereby providing fluid communication between the first cavity 32 and the second cavity 34. Other similar structural arrangements and gap formations can be used without departing from the spirit and scope of the present invention.

In one preferred and non-limiting embodiment, and as illustrated in FIGS. 3(*a*) and 3(*b*), the insulation material 30 is provided such that it contacts and extends along at least a portion of an inner surface 36 of the first partial web 18 and/or the second partial web 20. For example, the insulation material 30 may extend along about 0.5-1 inch of the inner surface 36 of the first partial web 18 and/or second partial web 20. In other preferred and non-limiting embodiments, the insulation material 30 extends about 1-2 inches along the inner surface 36 of the first partial web 18 and/or the second partial web 20. Of course, any desired overlap or contact between the inner surface 36 and the insulation material 30 can be provided. For example, this overlap, and/or the thickness of the insulation material 30 in the first cavity 32 and/or the second cavity 34, may be provided based upon meeting a standard, specification, and/or desired level of insulation (e.g., a desired R-value).

In one preferred and non-limiting embodiment, the insulation material 30 is sprayed, poured, or otherwise deposited into some or all of the first cavity 32 and/or the second cavity 34, such as through the use of a spray gun or other known application process. Any manner of applying or positioning this insulation material 30 in the first cavity 32 and/or second cavity 34 is envisioned. In one preferred and non-limiting embodiment, the insulation material 30 is a foam material that can be sprayed or poured into the first cavity 32 and/or the second cavity 34, as described above. For example, this insulation material 30 may be a closed-cell foam material or any material that provides the required or desired insulation characteristics and/or R-value. For example, in one preferred and non-limiting embodiment, the insulation material 30 provides an R-value of about 12 based upon the thickness (e.g., about two inches) of the insulation material 30 in the first cavity 32 and/or second cavity 34. Other preferred and non-limiting embodiments may have higher or lower R-values.

As further seen in FIGS. 3(*a*) and 3(*b*), the insulation material 30 may expand beyond an outer surface 38 of the first partial web 18 and/or the second partial web 20. This may occur due to the nature of the insulation material 30, as well as the application or manufacturing process for placing the insulation material 30 in the first cavity 32 and/or the second cavity 34. It is also noted that the insulation material 30, such as in the form of spray- or pour-applicable foam material, would also expand beyond and out of the first cavity 32 and/or the second cavity 34 if unconstrained. Therefore, it is envisioned that the manufacturing process would block and/or constrain such expansion using face plates or other barriers, thereby only allowing expansion out of the gaps 26 (as discussed above). In one preferred and non-limiting embodiment, this excess material may be removed or cut off during or after the manufacturing process. As discussed hereinafter, and once removed, this area of the insulation material 30 can be further utilized in the creation of a structure using the CMUs 10 of the present invention. In this manner, the CMU 10 provides an insulated CMU (or structural unit) for use in building or installing buildings, foundations, walls, load-bearing structures, and the like.

Figure 4:
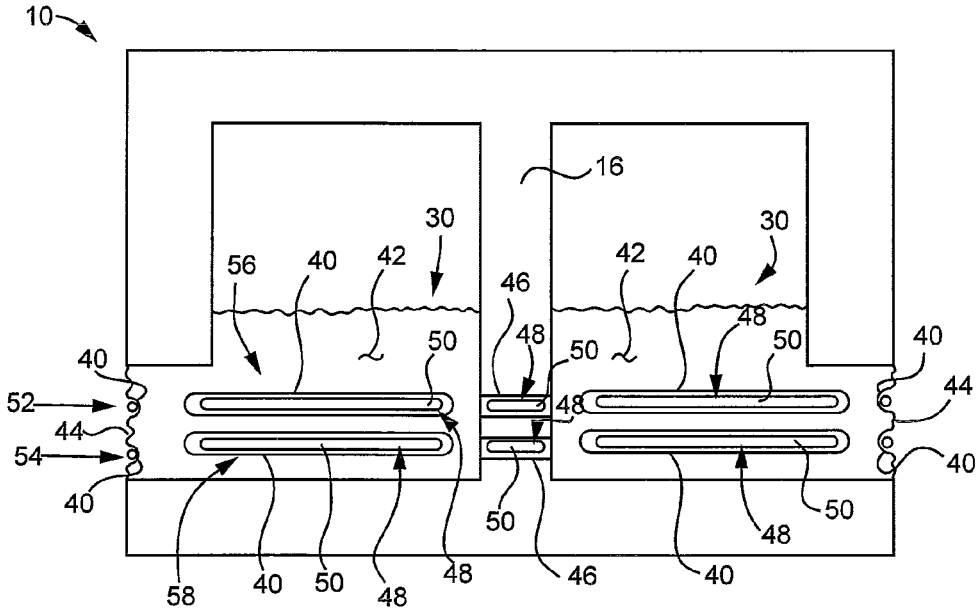
FIG. 4 is a top view of another embodiment of an insulated concrete masonry unit according to the principles of the present invention.

A further preferred and non-limiting embodiment of a CMU 10 according to the present invention is illustrated in FIG. 4. As discussed above, the insulation material 30 provides the appropriate insulative properties to the CMU 10. However, because many CMUs 10 may be used to create and/or install a large wall structure, it may be preferable to also provide insulation in the gaps and/or seams between CMUs 10. Accordingly, as illustrated in FIG. 4, further insulation may be provided during the insulation process between various portions of the CMU 10, such as by using a single or multiple component insulation material. In one preferred and non-limiting embodiment, a plurality of recesses 40 is provided on the face area 42 of the insulation material 30 and side areas 44 of the insulation material 30. In addition, and in this preferred and non-limiting embodiment, recesses 46 may also be formed in a portion of the central web 16. These recesses 40, 46 are configured and/or sized so as to accept an insulation container 48. The insulation container 48 may be in the form of a tube 50, a capsule, a bubble, and/or any other appropriate container capable of holding all of, a portion of, or a component of the insulation material 30.

In the preferred and non-limiting embodiment of FIG. 4, and when using a two-component insulation material as the multiple component material, a first row 52 of recesses 40, 46, and a second row 54 of recesses 40, 46 are provided on side areas 44 of the insulation material 30. These rows 52, 54 are aligned and spaced in order to specifically position a first set 56 of insulation containers 48 and a second set 58 of insulation containers 48. In this embodiment, the insulation material 30 is formed through the mixing and interaction of a first insulation material 60 and a second insulation material 62 (shown in FIG. 6), e.g., a two-part foam material. Upon release, and when the first insulation material 60 contacts the second insulation material 62, a reaction occurs and the foaming process is initiated, thereby creating the insulation material 30 in the first cavity 32 and/or second cavity 34. For example, as seen in the arrangement of FIG. 4, the first set 56 of insulation containers 48 include the first insulation material 60, and the second set 58 of insulation containers 48 includes the second insulation material 62. Accordingly, when released, the first insulation material 60 and the second insulation material 62 mix and create the insulation material 30, as discussed above.

In order to provide an appropriate release of the first insulation material 60 and the second insulation material 62, the insulation container 48 (in this preferred and non-limiting embodiment, a tube 50) may be formed from a material that dissolves upon contact with moisture or water. For example, the tubes 50 may be formed from a polyvinyl alcohol material, which represents a water soluble membrane that contains the first insulation material 60 and second insulation material 62. In operation, and when mortar is applied between one or more CMUs 10, the moisture or water from the mortar contacts the tubes 50, thereby releasing the first insulation material 60 and the second insulation material 62, which react and create the insulation material 30 in the seams or gaps between the CMUs 10. In this manner, a substantially complete insulation barrier is provided between the multiple, connected CMUs 10. In another preferred and non-limiting embodiment, the release of insulation material from the insulation container 48 is effected by means of applying mechanical energy to the insulation container 48. For example, the insulation container 48 may be physically pierced or pierced by vibrating the CMU 10, such as by ultrasonic energy. In yet another preferred and non-limiting embodiment, the release of insulation material from the insulation container 48 is effected by means of applying electromagnetic energy to the CMU 10. These activation mechanisms are provided for illustrative purposes only and are not intended to be limiting. It is within the scope of the present disclosure to include alternate activation mechanisms for releasing the insulation material from the insulation container 48.

Figure 5:
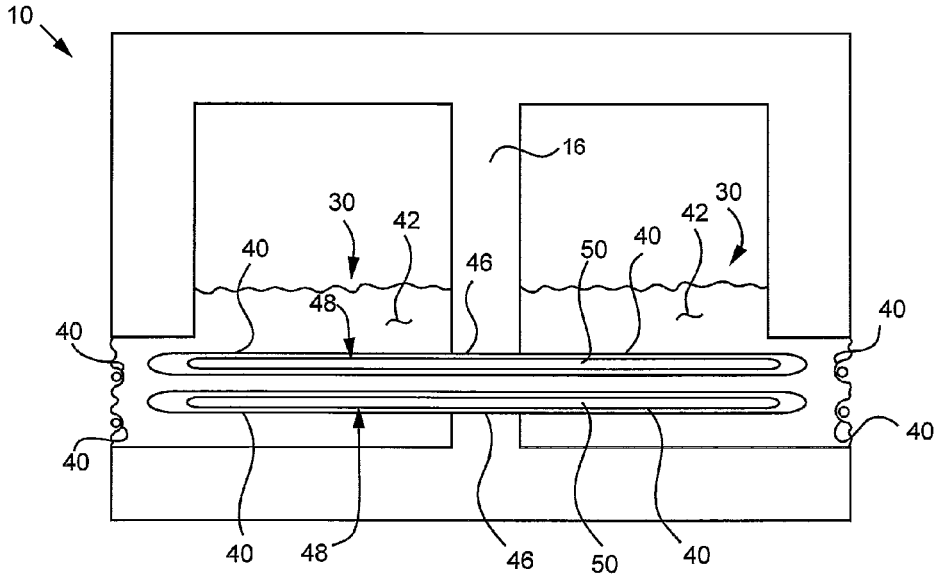
FIG. 5 is a top view of a further embodiment of an insulated concrete masonry unit according to the principles of the present invention.

A further preferred and non-limiting embodiment of the present invention is illustrated in FIG. 5. In this embodiment, the above-described recesses 40, 46 are provided in the insulation material 30 and the central web 16. However, in this embodiment, the insulation containers 48 are in the form of elongated tubes 50 that extend across aligned recesses 40, 46 on the face area 42 of the insulation material 30. It is also envisioned that an adhesive material may be used or applied at the base of the recesses 40, 46 in order to hold the insulation containers 48 in place during the transportation and/or delivery process. Of course, such an adhesive may not be necessary, as, based upon the orientation of the CMUs 10 during transportation and delivery, the insulation containers 48 remain positioned in the recesses 40, 46. Of course, it is also envisioned that the insulation containers 48 may be sized and shaped so as to be frictionally engageable in the recesses 40, 46, without the use of any adhesive or other attachment arrangement. Still further, it is envisioned that the diameter or size of the insulation containers 48 are such that they are recessed within the recesses 40, 46 and not extending out therefrom. This would ensure that the insulation containers 48 would not be accidentally impacted and broken or otherwise unintentionally opened. Still further, and as discussed above, these insulation containers 48 may be in a variety of forms and configurations. While mentioned and described above in connection with the form of a tube 50, these insulation containers 48 may be in the form of capsules, beads, or any other suitable container that can be positioned on the insulation material 30 and/or the recesses 40, 46. Any such arrangement is envisioned within the context of the present application in order to create this insulation material 30 in the gaps and/or seams between the CMUs 10.

Figure 1B:
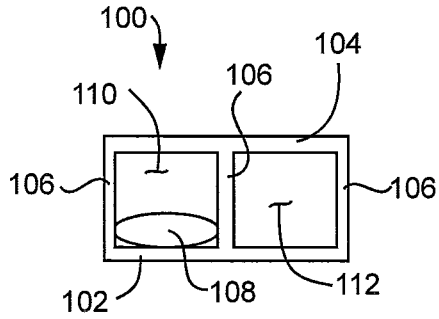
Fig. 1(b) PRIOR ART
Figure 6:
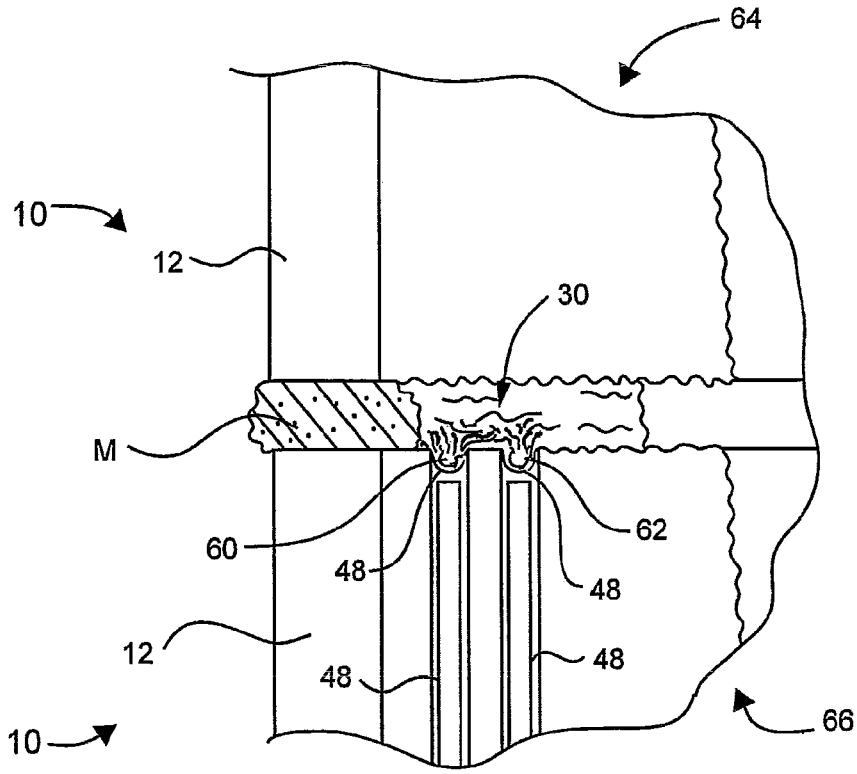
FIG. 6 is a detailed sectional view of the insulated concrete masonry unit of FIG. 5 during installation.

As illustrated in one preferred and non-limiting embodiment of FIG. 6, mortar M is applied between two first face shells 12 of a first CMU 64 and a second CMU 66, specifically at the interface between these face shells 12. The moisture from the mortar M contacts the insulation containers 48, thereby releasing the first insulation material 60 and the second insulation material 62. As discussed above, other activation mechanisms for releasing the insulation material from the insulation containers 48 are also contemplated. Upon mixing, the insulation material 30 is formed and expands to fill in the gap between the first CMU 64 and the second CMU 66, preferably in the area between the existing insulation materials 30 of the respective CMU 64 and second the CMU 66. This creates a contiguous insulative barrier that extends between the first CMU 64 and the second CMU 66. Of course, this same process occurs when mortar M is applied between the sides of the first CMU 64 and the second CMU 66. Although not illustrated, when this mortar M is applied to the sides of the CMUs 64, 66, the insulation containers 48 in that area would react as described above, thereby providing insulation between the sides of adjacent CMUs 10. Still further, it is envisioned that this process of insulating the gaps between adjacent CMUs 10 may be used in connection with existing CMUs, such as the CMU 100 illustrated in FIGS. 1(*a*) and 1(*b*).

In summary, the present invention provides a structural unit insulation arrangement, system, and process that provide an effective insulation layer for structures built using CMUs. Based upon the unique configuration of the CMUs 10, an effective insulation barrier is provided on a per-CMU 10 basis during the manufacturing process. In addition, and using the insulation containers 48, further insulation material 30 is provided between the gaps and/or seams between stacked and/or adjacent CMUs 10, 100 during the installation process.

Of course, it is envisioned that any appropriate insulation material 30 may be utilized that exhibits the required or desired R-value or other insulation-based properties. Further, any manufacturing or forming process that positions or places this insulation material 30 in the CMU 10 is envisioned. Also, while discussed above in connection with a two-part or two-component foam material, any insulation material 30 may be utilized, where this insulation material 30 can be reacted or formed in the field. A two-component foam is discussed herein based upon its beneficial R-value, e.g., around 10 or higher, as well as its high compression characteristic, e.g., about 25 to about 30 pounds per square inch. Still further, such a foam insulation material 30 is waterproof to provide an additional benefit and advantage to the constructed structure.

As discussed, any manufacturing process can be used to provide and manufacture the above-described CMU 10 having the insulation material 30, and such manufacturing processes are known in the art. The present invention contemplates making modifications to the manufacturing or known processes regarding the spraying or pouring application or creation of insulation material 30, including the automation of such a process or formation of the insulation material 30, e.g., the above-discussed use of some constraints to bound the expansion of the insulation material 30.

In this manner, the present invention provides a structural unit insulation arrangement, system, and process that overcomes and/or addresses the deficiencies in the field of structural unit manufacturing and installation.

Although the invention has been described in detail for the purpose of illustration based on what are currently considered to be practical and preferred embodiments, it is to be understood that such detail is solely for that purpose and that the invention is not limited to the disclosed embodiments, but, on the contrary, is intended to cover modifications and equivalent arrangements that are within the spirit and scope hereof. For example, it is to be understood that the present invention contemplates that, to the extent possible, one or more features of any embodiment can be combined with one or more features of any other embodiment.

What is claimed is:

1. A structural unit comprising:

a first face shell having a first edge and a second edge;

a second face shell having a first edge and a second edge, the second face shell positioned opposite the first face shell;

at least one central web connecting the first face shell to the second face shell;

a first partial web extending from the first edge of the first face shell toward the first edge of the second face shell and forming a gap between an end of the first partial web and the first edge of the second face shell, wherein a first cavity is defined by the first face shell, the second face shell, the at least one central web, and the first partial web;

a second partial web extending from the second edge of the first face shell toward the second edge of the second face shell and forming a gap between an end of the second partial web and the second edge of the second face shell, wherein a second cavity is defined by the first face shell, the second face shell, the at least one central web, and the second partial web;

a first insulation material provided in at least one of the first and second cavities; and a second insulation material provided within at least a portion of the first insulation material, wherein the second insulation material is a two-component material formed by mixing a first insulation component and a second insulation component, wherein the first insulation component is stored in a first container and the second insulation component is stored in a second container, and wherein, upon release from the first and second containers, the first and second insulation components mix to form the second insulation material.

2. The structural unit of claim 1, wherein the first insulation material is provided in at least a portion of the first and second cavities, and wherein the first insulation material at least partially fills the gap.

3. The structural unit of claim 1, wherein the first insulation material is a foam material sprayed into the first and second cavities.

4. The structural unit of claim 3, wherein the foam material is closed-cell foam.

5. The structural unit of claim 1, wherein at least one of the first and second containers is formed as at least one of a tube, a capsule, and a bubble that is dissolved by contact with water or moisture, or by application of mechanical or electromagnetic energy.

6. The structural unit of claim 1, wherein the first and second containers are retained within at least one recess formed within at least one of the first insulation material and the central web.

7. The structural unit of claim 6, wherein the first and second containers are retained within the at least one recess by an adhesive.

8. The structural unit of claim 6, wherein the first and second containers are retained within the at least one recess by frictional engagement with the at least one recess.

9. The structural unit of claim 6, wherein a plurality of recesses is formed within the at least one of the first insulation material and the central web.

10. An insulated masonry block for use as a structural unit in a structure, the masonry block comprising:

a first face shell having a first edge and a second edge;

a second face shell having a first edge and a second edge, the second face shell positioned opposite the first face shell;

at least one central web connecting the first face shell to the second face shell;

a first partial web extending from the first edge of the first face shell toward the first edge of the second face shell and forming a gap between an end of the first partial web and the first edge of the second face shell, wherein a first cavity is defined by the first face shell, the second face shell, the at least one central web, and the first partial web;

a second partial web extending from the second edge of the first face shell toward the second edge of the second face shell and forming a gap between an end of the second partial web and the second edge of the second face shell, wherein a second cavity is defined by the first face shell, the second face shell, the at least one central web, and the second partial web;

a first insulation material provided in at least one of the first and second cavities, wherein the first insulation material at least partially fills the gap; and, a second insulation material provided within at least a portion of the first insulation material, wherein the second insulation material is a two-component material formed by mixing a first insulation component and a second insulation component, wherein the first insulation component is stored in a first container and the second insulation component is stored in a second container, and wherein, upon release from the first and second containers, the first and second insulation components mix to form the second insulation material.

11. The insulated masonry block of claim 10, wherein at least one of the first and second containers is formed as at least one of a tube, a capsule, and a bubble that is dissolved by contact with water or moisture, or by application of mechanical or electromagnetic energy.

12. The insulated masonry block of claim 10, wherein the first insulation material is a foam material sprayed into the first and second cavities.

13. A method of manufacturing an insulated masonry block for use as a structural unit in a structure, the method comprising:

manufacturing the masonry block, comprising: a first face shell having a first edge and a second edge; a second face shell having a first edge and a second edge, the second face shell positioned opposite the first face shell; at least one central web connecting the first face shell to the second face shell; a first partial web extending from the first edge of the first face shell toward the first edge of the second face shell and forming a gap between an end of the first partial web and the first edge of the second face shell, wherein a first cavity is defined by the first face shell, the second face shell, the at least one central web, and the first partial web; and a second partial web extending from the second edge of the first face shell toward the second edge of the second face shell and forming a gap between an end of the second partial web and the second edge of the second face shell, wherein a second cavity is defined by the first face shell, the second face shell, the at least one central web, and the second partial web;

providing a first insulation material in at least one of the first and second cavities; and providing a second insulation material within at least a portion of the first insulation material wherein the second insulation material is a two-component material formed by mixing a first insulation component and a second insulation component, wherein the first insulation component is stored in a first container and the second insulation component is stored in a second container, and wherein, upon release from the first and second containers, the first and second insulation components mix to form the second insulation material.

* * * * *